US005325565A

United States Patent [19]

Suzuki

[11] Patent Number: 5,325,565

[45] Date of Patent: Jul. 5, 1994

[54] DEVICE FOR COLLECTING DUST, WATER OR THE LIKE

[75] Inventor: Yasuhiro Suzuki, Tokyo, Japan

[73] Assignee: Kabushiki Kaisha Hoky, Nagareyama, Japan

[21] Appl. No.: 947,175

[22] Filed: Sep. 18, 1992

[30] Foreign Application Priority Data

Sep. 30, 1991 [JP] Japan ..... 3-251310

[51] Int. Cl.[5] ..... A47L 13/52

[52] U.S. Cl. ..... 15/257.4; 15/257.9

[58] Field of Search ..... 15/257.4, 257.9

[56] References Cited

U.S. PATENT DOCUMENTS

| | | | |
|---|---|---|---|
| 238,942 | 3/1881 | Macardle | 15/257.9 |
| 277,266 | 5/1883 | Godfrey | 15/257.9 |
| 469,709 | 3/1892 | Miles | 15/257.9 X |
| 677,950 | 7/1901 | Cutter | 15/257.4 |
| 3,121,248 | 2/1964 | Ferguson | 15/257.9 |
| 3,802,729 | 4/1974 | Akre . | |
| 3,827,098 | 8/1974 | Sanderson . | |

FOREIGN PATENT DOCUMENTS

| | | | |
|---|---|---|---|
| 1332021 | 6/1963 | France | 15/257.4 |

*Primary Examiner*—Chris K. Moore

*Attorney, Agent, or Firm*—Ladas & Parry

[57] ABSTRACT

In order to elevate workability in collecting refuse and the like, an elastic blade is attached to an extreme end of an opening of a main body of a collecting device in order to provide an intimate contact with the surface of a floor. A rotating shaft extending laterally along the under side of the blade is provided therein at the rear of the same, and this rotating shaft is pivotally supported between two opposing sidewalls of the collecting device main body, whereby the front edge of the blade is rotatably urged towards and away from the surface of the floor due to the elastic force derived from the bottom of the blade through the rotating shaft. The blade is gradually elevated towards the rear end to form an inclined portion, whereby a prescribed amount of refuse and the like collected within the opening can be held on the inclined portion. On the opposite side surfaces of the blade, each sidewall is provided with the blade so as not to drop refuse and the like once swept up.

8 Claims, 7 Drawing Sheets

DEVICE FOR COLLECTING DUST, WATER OR THE LIKE

BACKGROUND OF THE INVENTION

1. Field of the Invention

The present invention relates to a collecting device, and in particular, to a device used to sweep or collect refuse, including dust, as well as rainwater, standing water or the like (hereinafter referred to simply as "water and the like") from a surface of a floor.

2. Description of the Related Art

A broom has been conventionally used to gather refuse. A squeegee or the like has also been used in conjunction with a dust-pan or the like to sweep up dust or water and the like.

However, the conventional dust-pan as described above after has a gap between a blade attached to the extreme end of an opening in a dust-pan and the surface of a floor, especially a floor with an uneven or irregular surface, when dust or water and the like on the surface of the floor is swept up by a squeegee or the like. As a result, some dust or water and the like is pushed into the back of the dust-pan and some is pushed under the dust pan. In use, this means that the dust pan is moved backwards step-wise to try to collect the refuse which was swept under the pan previously.

OBJECT AND SUMMARY OF THE INVENTION

One of the objectives of the present invention is to eliminate the problems described above by providing a collecting device having a blade that is attached to the extreme end of an opening in a main body of the collecting device in intimate contact with the surface of a floor. As a result, a user of such collecting device may sweep up dust or water and the like repeatedly without the aforementioned shortcomings that are prevalent in the prior art.

Accordingly, the present invention is characterized by a collecting device having a main body with an opening at one end a blade made of rubber or the like having elasticity which is attached to one end of the opening, a rotating shaft extending laterally along the under side of the blade so that the blade may move rotatably up and down relative to the opening of the main body. In addition, the blade is inclined towards the rear in order to gradually increase its height, and the bottom of the blade at the rear thereof abuts against the bottom of the collecting device main body with elastic force, whereby the front edge blade is rotatably urged to be in intimate contact with the surface of the floor.

Based on the construction as described above, when dust, water or the like on the surface of a floor is swept up by means of a squeegee into the collecting device according to the present invention, such dust, water or the like is positively captured without pushing the same under the blade, because the blade at the extreme end of the opening in the collecting device main body comes into intimate contact with the surface of a floor.

BRIEF DESCRIPTION OF THE DRAWINGS

The present invention will become more fully understood from the detailed description given hereinbelow and the accompanying drawings which are given by way of illustration only, and thus are not limiting of the present invention, and wherein.

DETAILED DESCRIPTION OF THE PREFERRED EMBODIMENTS

Embodiments of the present invention will be described in detail hereinbelow in conjunction with the accompanying drawings.

Figure 1:
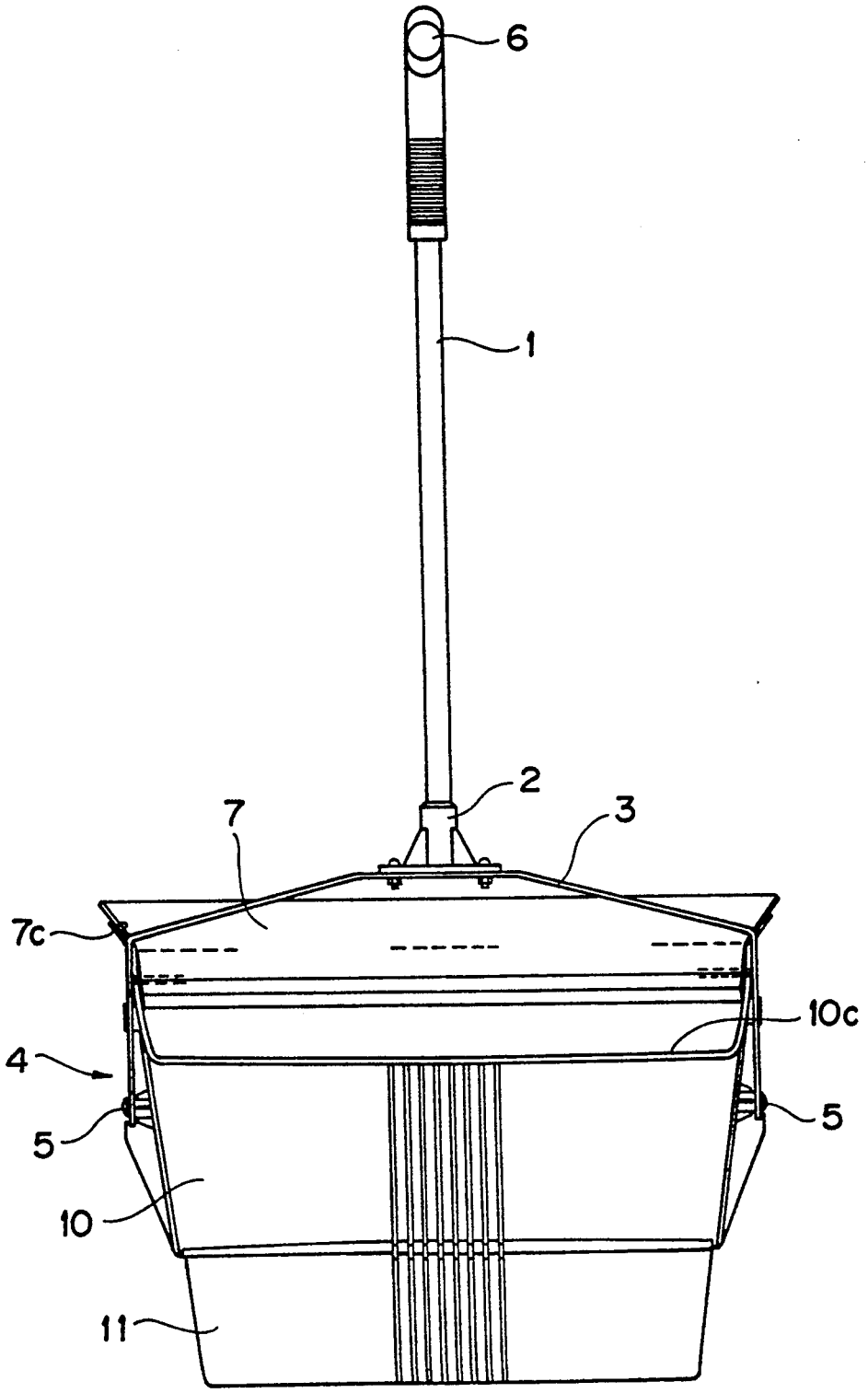
FIG. 1 is a top view showing the entire structure of a collecting device of the first embodiment according to the present invention.
Figure 2:
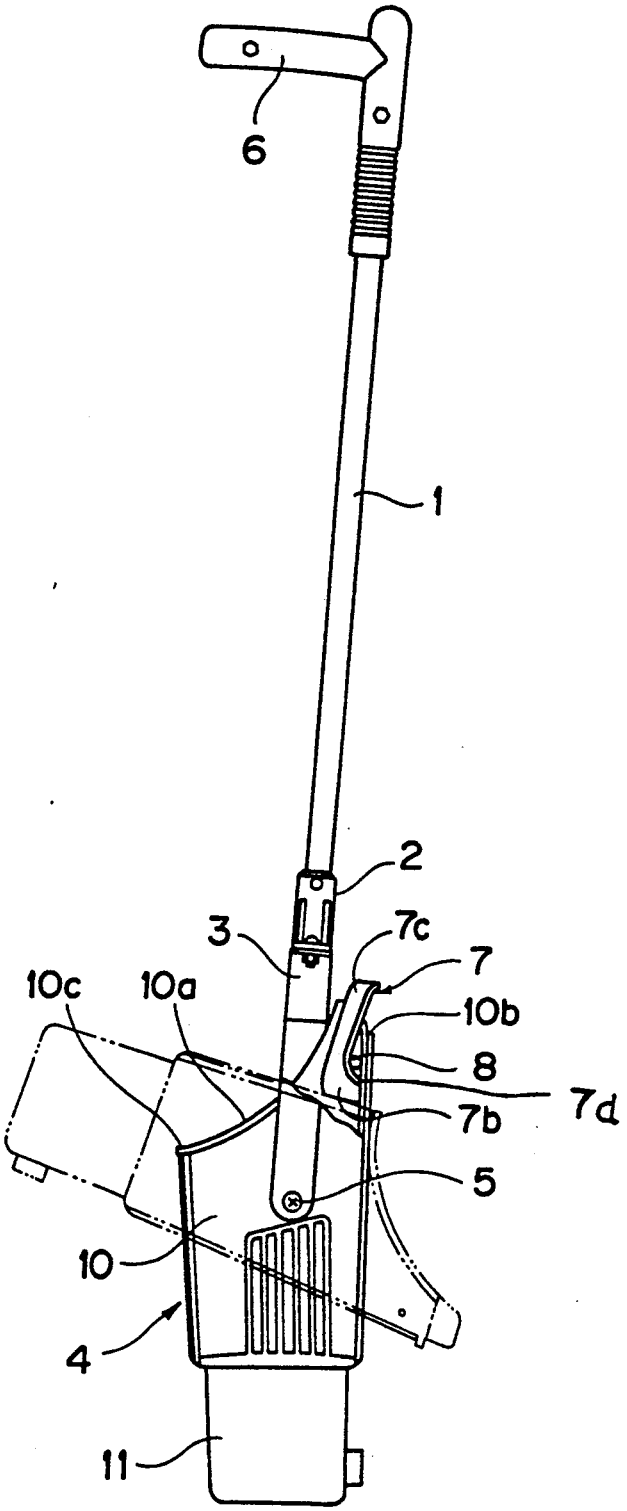
FIG. 2 is a partly cutaway side view of FIG. 1.
Figure 3:
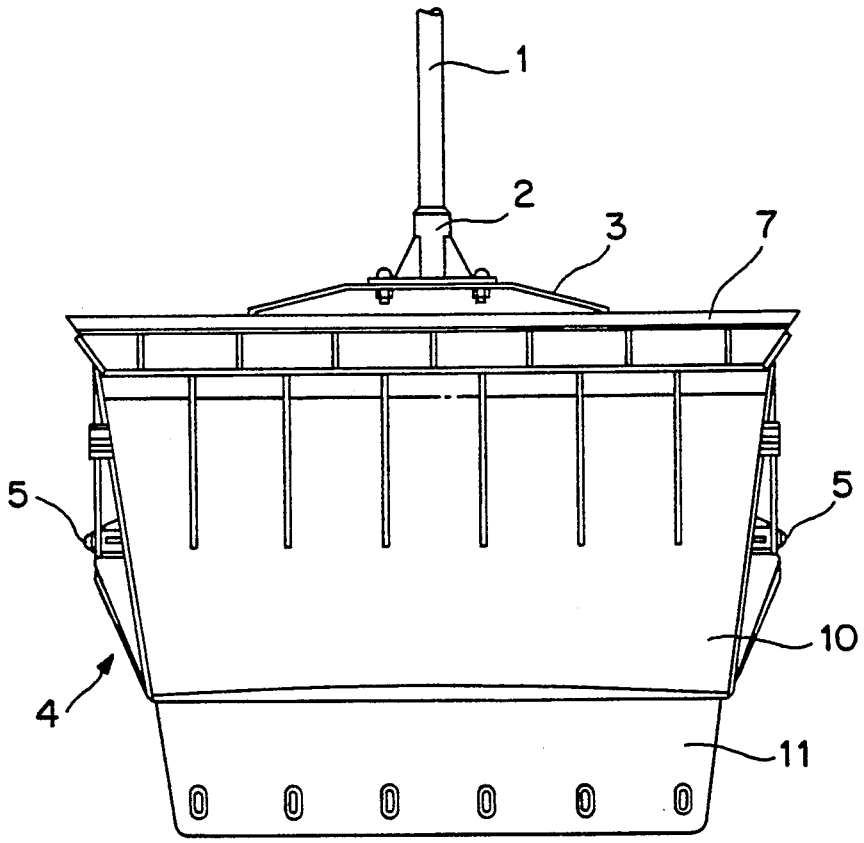
FIG. 3 is a bottom view of FIG. 1.

FIGS. 1, 2 and 3 show a collecting device of the first embodiment according to the present invention which is suitable for sweeping up dust or the like. FIG. 1 is a top view showing the entire structure of the collecting device, FIG. 2 is a side view showing the entire structure of the collecting device of FIG. 1, and FIG. 3 is a bottom view showing the same collecting device of FIG. 1. Reference is first made to FIG. 1 of the drawings, which shows a rod-like handle 1 made from an aluminum pipe with a prescribed length, a connector 2 fixed to an extreme end portion of the handle 1, a bifurcated crank arm 3 secured to the connector 2, and a collecting device main body 4 rotatably attached to the opposing sides of the bifurcated crank arm 3 through shafts 5, respectively.

An L-shaped grip 6 extends in a prescribed direction at a right angle and is fittingly mounted on the rear end portion of the aforesaid handle 1 at an optimal gripping position. While handle 1 is made from a single rod having a predetermined length, it is not limited thereto, and the handle may be constructed in such a way that an inner pipe (not shown) is inserted into an outer pipe (not shown) in a two-stepped extendible manner, consequently, length of the resulting handle is adjustable by the use of a chuck or the like.

Figure 7:
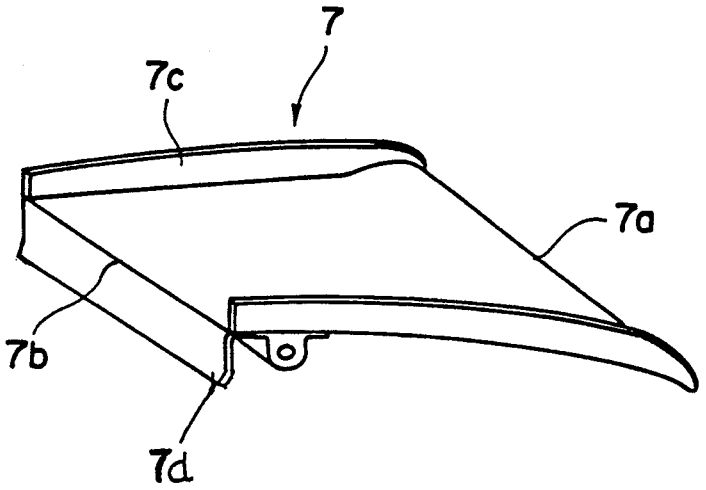
FIG. 7 is a perspective view showing the profile of a blade.

The collecting device main body 4 has a box-shaped dust collecting section 10 made of a synthetic resin material or the like and having a wide opening 10*a* at an anterior portion of the main body 4, and a dust pan 11 constructed integrally with the dust collecting section 10 at the rear thereof. When a user holds up the handle 1 of the collecting device, the opening 10*a* of the dust collecting section 10 faces upwardly due to the position 1 of the shafts 5 which rotatably support the collecting device main body 4. The dust collecting section 10 has an edge portion 10*b* on the bottom side of the opening 10*a* which extends further than edge portion 10*c* which positioned at the upper side of the main body. A blade 7 made from a resilient material such as rubber and the like and, which is shown in detail in FIG. 7 is mounted on the extreme end of the opening 10*a* so as to cover the edge 10*b*.

A rotatable shaft 8 extends laterally along the underside of the blade 7 at the rear portion thereof. The rotatable shaft 8 is pivotally supported between the two opposing side walls of the dust collecting section 10 of the collecting device main body 4, whereby the front edge 7*a* of the blade 7 can brought into close contact with the surface of a floor by rotating on rotatable shaft 8. The surface of the blade 7 raises gradually towards the rear end thereof to form an inclined portion 7*b*, whereby a prescribed amount of dust collected through the opening 10*a* can be held on the inclined portion 7*b* formed at the rear end of the blade 7. This inclined portion 7*b* holds the already collected refuse in place in the main body 4. On the opposite side surfaces of the blade 7, a pair of opposing sidewalls 7*c* are provided to cooperate with the blade so to keep the already collected dust in place. Furthermore, the inclined portion 7*b* has a bottom portion 7*d* positioned at the rear end of the blade 7 which abuts elastically upon the bottom surface of the dust collecting section 10. Thus, the blade 7 is rotatably mounted by means of bottom portion 7*d* to rotate on the rotatable shaft 8 whereby the front edge 7*a* of the blade 7 can always be brought into close contact with the surface of a floor.

Next, operation of the first embodiment constructed as described above in accordance with the present invention will be explained.

First, a user sweeps refuse from the surface of a floor using a conventional tool for that purpose. Next, the user holds the collecting device at its handle 1, so the opening 10*a* of the dust collecting section 10 as well as the front edge 7*a* of the blade 7 contacts the floor surface. When the amount of collected refuse accumulated in the box-shaped refuse collecting section reaches the vicinity of the inclined portion 7*b* located at the rear of the blade 7, the user can force collected refuse into the dust pan 11 by lifting up the handle 1 which forces the collecting device main body 4 to be perpendicular with the surface to be swept. When the opening 10*a* of the collecting device main body 4 is allowed to return to its original position, i.e., with the major portion parallel to the cleaning surface, refuse collection resumes.

Figure 4:
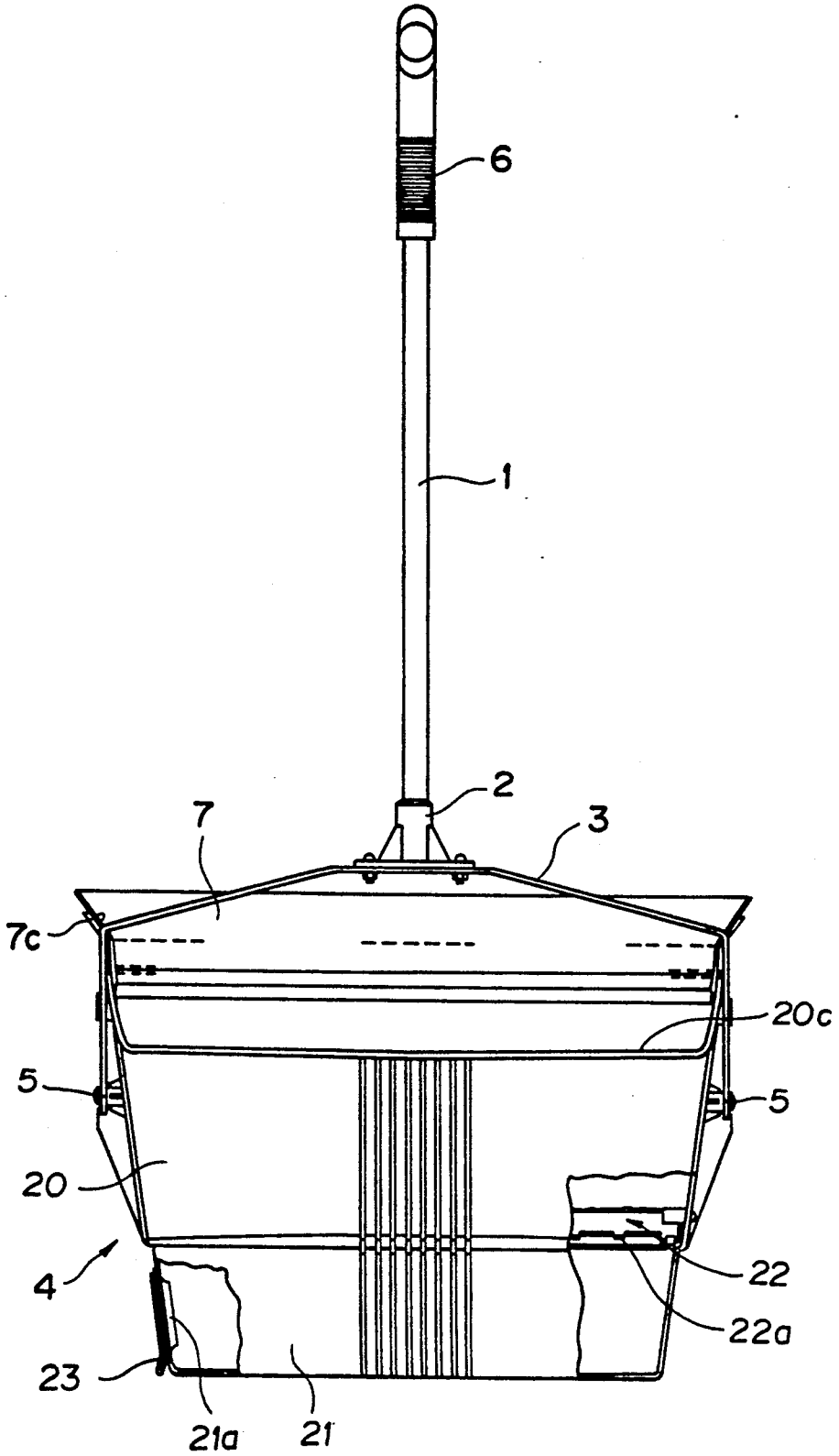
FIG. 4 is a partly cutaway top view showing the entire structure of a collecting device of the second embodiment according to the present invention.
Figure 5:
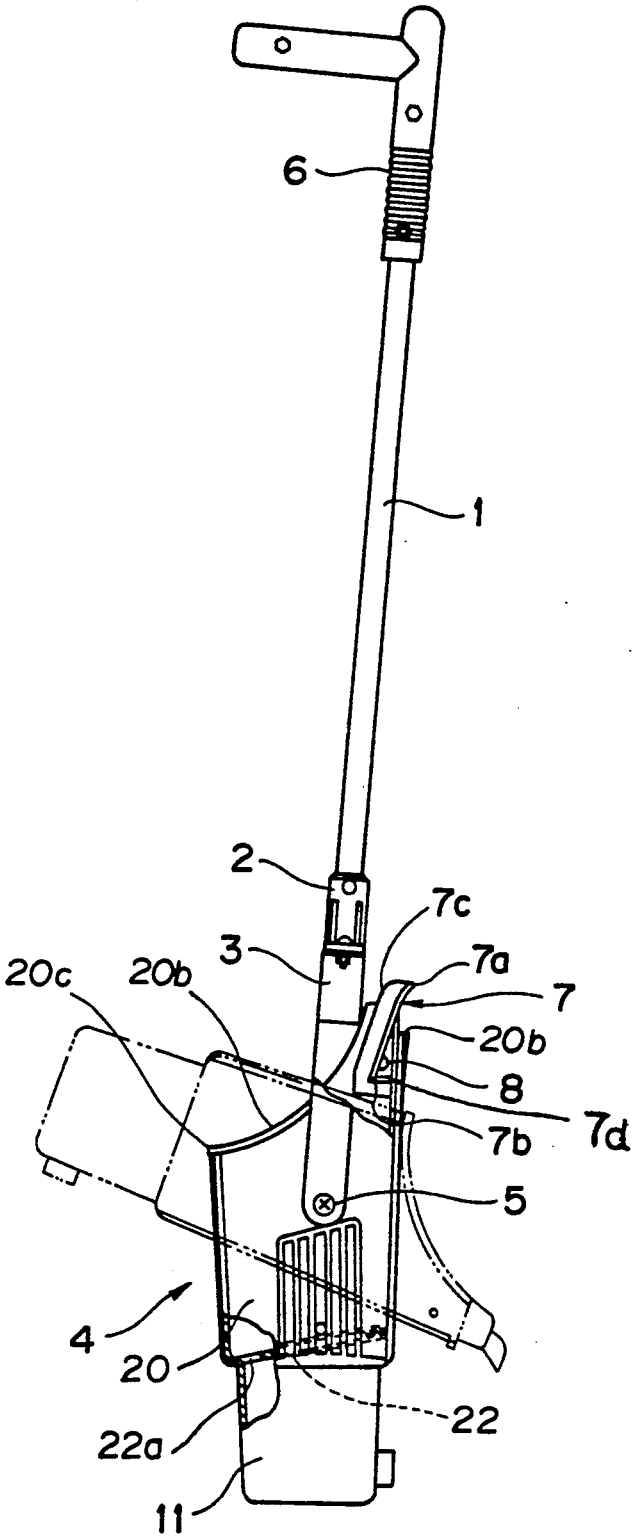
FIG. 5 is a partly cutaway side view of FIG. 4.
Figure 6:
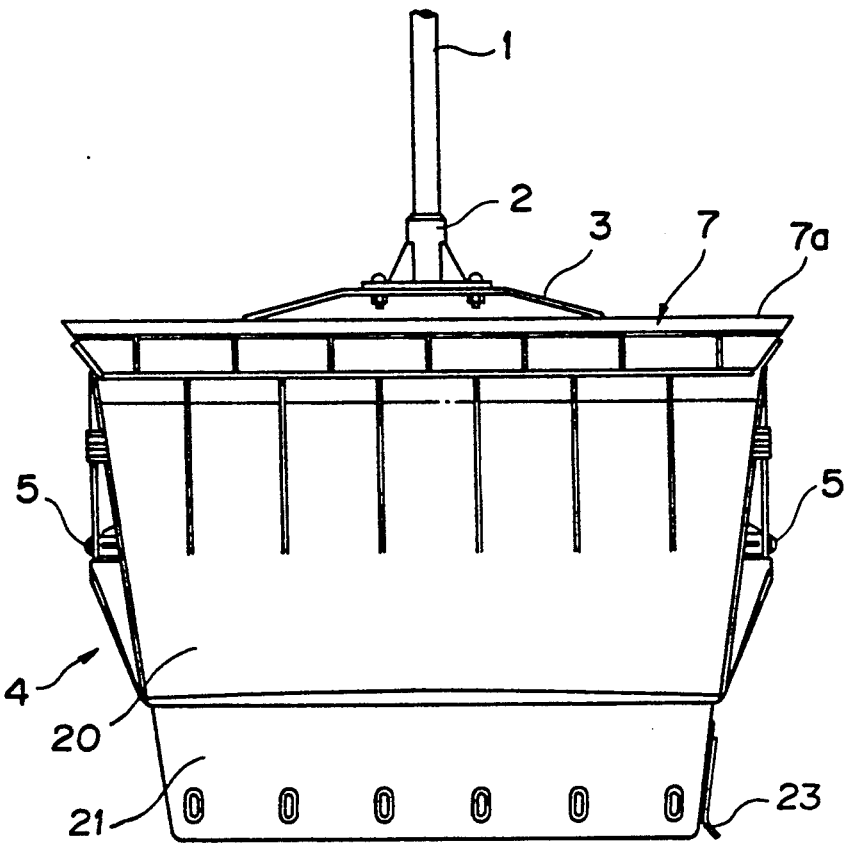
FIG. 6 is a bottom view of FIG. 4.

FIGS. 4, 5 and 6 show a collecting device of a second embodiment of to the present invention which may be suitably used for sweeping up rainwater, standing water or the like. FIG. 4 is a top view showing the entire structure of a collecting device. FIG. 5 is a partly cutaway side view of FIG. 4. FIG. 6 is a bottom view of FIG. 4. In these figures, members are identified by corresponding reference numerals used in the first embodiment, and therefore a detailed explanation is not considered necessary.

The collecting device main body 4 is composed of a box-shaped water collecting section 20 made from a synthetic resin material or the like has a wide opening 20*a* at the front thereof, and has a water pan 21 constructed integrally with the water collecting section 20 at the rear thereof. When a user holds up the handle 1 of the collecting device, the opening 20*a* of the water collecting section 20 turns upwardly from the surface to be cleaned by rotating on shafts 5 which rotatably support the collecting device main body 4. Furthermore, the water collecting section 20 has an edge portion 20*b* on the bottom side of the opening 20*a* which extends further than an edge portion 20*c* on the upper side thereof. A blade 7, made from an elastic material such as rubber or the like and shown in FIG. 7, is mounted on an extreme end of the opening 20*a* so as to cover the edge 20*b* on the bottom side thereof.

A rotatable shaft 8 extends laterally along the under side of the blade 7 at the rear thereof. Furthermore, the rotatable shaft 8 is pivotally supported between the side walls constituting the water collecting section 20 of the collecting device main body 4, whereby the front edge 7*a* of the blade 7 can brought into close contact with the surface of a floor in an up and down rotatable manner by rotating the dust bin on rotatable shaft 8. The surface of the blade 7 is gradually inclined towards the rear end thereof to form an inclined portion 7*b*, whereby a water level of the filthy water collected through the opening 20*a* can be held on the inclined portion 7*b* formed at the rear end of the blade 7 by a prescribed amount higher. On the opposite side surfaces of the blade 7, each side wall 7*c* cooperates with the blade so as not to allow rainwater or standing water, once gathered up, to run out from the sides of the blade 7. Furthermore, the blade 7 is arranged so that the bottom 7*d* of the inclined portion 7*b* positioned at the rear end of the blade 7 abuts elastically upon the bottom surface of the water collecting section 20, and thus, the blade 7 is rotatably mounted on the rotatable shaft 8 so that the front edge 7*a* of the blade 7 tends to move into close contact with the surface of a floor.

On the other hand, both circumferences of the water collecting section 20 and the water pan 21 in the collecting device main body 4 are sealed by a packing and the like, and further the water collecting section 20 is separated from the water pan 21 by a shield plate 22 disposed in such a manner so that the lower end of which descends towards the front end of the collecting device main body 4. On the upper portion of the shield plate 22, a notch-formed communicating hole 22*a* is defined for communicating the water collecting section 20 to the water pan 21. In the course of gathering up rainwater, standing water and the like, when a user holds up handle 1 to turn over the collecting device main body 4 to direct the opening 20*a* upwards the rainwater, standing water and the like collected by the water collecting section 20 passing through the communication hole 22*a* of the shield plate 22, whereby such water is contained in the water pan 21. In addition, a drain hole 21*a* is defined in the rear wall or either of the side walls of the water pan 21 at an appropriate position, and the drain hole 21*a* is normally closed with a plug 23 made of rubber or the like.

Next, operation of the second embodiment constructed as described above in accordance with the present invention will be explained.

First, refuse water found on a surface of a floor either from cleaning or due to rainfall is collected by placing the collecting device main body 4 in contact with the surface of the floor by gripping handle 1 of the collecting device with a user's hand such that the opening 20*a* of the water collecting section 20 comes into contact with the floor surface. At the same time, the front edge 7*a* of the blade 7 also comes into close contact with the surface of the floor, so that the refuse on the floor can be easily collected by using a squeegee or the like. When the collected liquid refuse up to the vicinity of the inclined portion 7*b* at the rear of the blade 7, the user will lift up handle 1 which will cause the collecting device main body 4 to be perpendicular with the surface of the floor and wherein the opening 20*a* turns upward. This action causes the liquid refuse to drop into the water pan 21 through the communicating hole 22*a* of the inside shield plate 22. When the collecting device main body 4 is allowed to return to its original position, the user can again resume gathering up rainwater or standing water. When plug 23 disposed in the collecting device main body 4 is released, the rainwater or standing water which was once gathered up into the water pan 21 and has been contained therein is discharged into another container or into an outside drain system or the like.

As described in detail hereinabove, the following advantages can be obtained by the collecting device according to the present invention.

(1) A blade attached to the extreme end of the opening of a collecting section is prepared from a soft material having elasticity, the front edge of the blade moves up and down as the rear end rotates as an axis so as to cover the front edge portion of the collecting device. As a result, the extreme end of the blade comes into close contact with the surface of a floor, whereby refuse such as dust, water or the like can be positively swept up.

(2) The collecting device of the invention has a simple construction and design which plays a significant role in its functionality. The device may be held in its standing position, while not in use, so it is perpendicular to the surface of the floor. When in use, it is brought parallel to the surface of the floor. In addition, since the main body is made of a synthetic resin, thus, is free from corrosion, rust, noisy operation, and it is durable.

(3) The adoption of the T-shaped handle, enable a user to operate the collecting device in a position most natural to a human body while the device is either in use or in transit, thus, it reduces the possibility of fatigue from using the device over an extended period of time.

(4) The opening and the large capacity of the collecting device main body enable the device to hold a greater quantity of refuse such as dust, water or the like, than a conventional collecting device.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A refuse collecting device for collecting debris from the surface of a floor comprising:

a main body having an opening at a front end thereof;

a blade made of an elastic material, which is attached adjacent an extreme end of said opening of said main body;

a rotating shaft which extends laterally along an underside of said blade at a rear end thereof, said rotating shaft being pivotally supported between opposite sidewalls of said collecting device main body, whereby a front edge of said blade is moveable toward and away from the surface of the floor by rotating on said shaft, said blade having an inclined portion toward the rear end thereof, said inclined portion being arranged to contact said main body and to provide a substantially vertical barrier to inhibit dust from exiting said device when said device is rested upon the floor.

2. A device for collecting dust swept up from a surface of a floor comprising:

a collecting device having a dust collecting section with an opening at a front portion thereof, and a dust pan at a rear portion of said dust collecting section and;

a blade mounted adjacent said opening in the collecting device;

a shaft which extends laterally along the under side of said blade at a rear portion thereof and which rotationally supports said blade, said shaft being pivotally supported between opposite sidewalls, of said dust collecting section, whereby a front edge of said blade which extends beyond said opening and towards the surface of the floor when the device, in use, is rested on the surface of the floor to collect dust, said blade having an inclined portion at a rear edge thereof, the inclined portion being firmly seated on the collecting device to provide a barrier to inhibit exiting of collected refuse when, in use, the device is rested on the floor.

3. A device for collecting liquid refuse, such as rainwater, standing water and the like gathered up from a surface of a floor comprising:

a main body comprising a water collecting section having an opening, a rear portion of said main body providing a water pan; a shield plate disposed between a border of said water collecting section and said water pan; and a notched communicating hole defined at an upper portion of said shield plate so as to communicate said water collecting section with said water pan; and an elastic blade mounted adjacent said opening in the collecting device;

a rotating shaft extending laterally along an underside of said blade at a rear portion thereof, said rotating shaft being pivotally supported between two opposing sidewalls, of said collecting device main body, said blade having a front edge which extends beyond said opening and which, in use, extends down to the floor and having a barrier which, in use, is firmly seated for an inside floor of the pan to provide a vertical wall to inhibit exiting of collected refuse when the device is rested on said floor.

4. The device of claim 2, wherein said inclined portion is elastic.

5. The device of claim 3 wherein said barrier is elastic.

6. A refuse collecting device comprising:

a refuse collecting bin with a cavity having an opening for collecting liquid and/or solid refuse; and an elastic blade attached to said cavity through a rotatable shaft extending between two opposing sidewalls of said cavity;

wherein said blade has a first end and a second end, said first end extending outwardly from said opening of said cavity in one direction, said second end extending in an opposite direction form said one direction and having an inclined portion at said second end, whereby one edge of said incline portion abuts an inner surface of said cavity to provide a barrier disposed at essentially a right angle to said inner surface to inhibit exiting of collected refuse when said elastic blade is rotated, in use, on said shaft.

7. The refuse collecting device in claim 6 wherein when said inclined portion of said second end of said blade is urged against said inner surface of said cavity when said first end of said blade contacts a surface of a floor when said device is rested thereon.

8. The refuse collecting device in claim 6 wherein said inclined portion of said second end of said blade serves as a barrier to prevent an already collected refuse from re-exiting said cavity.

* * * * *